US005139598A

United States Patent [19]

Chou et al.

[11] Patent Number: 5,139,598

[45] Date of Patent: Aug. 18, 1992

[54] VAPOR DEPOSITED MULTI-LAYERED FILMS—A METHOD OF PREPARATION AND USE IN IMAGING

[75] Inventors: Hsin-Hsin Chou; Kam K. Kam, both of Woodbury, Minn.; Rebecca M. Williams, Ithaca, N.Y.

[73] Assignee: Minnesota Mining and Manufacturing Company, Saint Paul, Minn.

[21] Appl. No.: 775,782

[22] Filed: Oct. 11, 1991

[51] Int. Cl.[5] ..... B41M 5/26

[52] U.S. Cl. ..... 156/234; 156/277; 428/195; 428/336; 428/412; 428/419; 428/473.5; 428/474.4; 428/484; 428/488.1; 428/500; 428/523; 428/913; 428/914

[58] Field of Search ..... 428/195, 212, 329, 331, 428/336, 412, 419, 473.5, 474.4, 484, 488.1, 500, 523, 913, 914; 430/276, 5; 156/234, 277

[56] References Cited

U.S. PATENT DOCUMENTS

| | | | |
|---|---|---|---|
| 3,136,637 | 6/1964 | Larson | 96/75 |
| 3,671,236 | 6/1972 | Van Beusekom | 96/15 |
| 3,811,884 | 5/1974 | Inoue et al. | 96/27 |
| 3,822,122 | 7/1974 | Plumat et al. | 65/30 |
| 4,212,936 | 7/1980 | Giampieri | 430/503 |
| 4,230,789 | 10/1980 | Fish | 430/159 |
| 4,262,087 | 4/1981 | Quaglia | 430/503 |
| 4,268,541 | 5/1981 | Ikeda et al. | 427/177 |
| 4,271,256 | 6/1981 | Kido et al. | 430/253 |
| 4,307,182 | 12/1981 | Dalzell et al. | 430/339 |
| 4,336,323 | 6/1982 | Winslow | 430/339 |
| 4,430,366 | 2/1984 | Crawford et al. | 427/162 |
| 4,470,714 | 9/1984 | Aviram et al. | 400/241.1 |
| 4,491,432 | 1/1985 | Aviram et al. | 400/241.1 |
| 4,549,824 | 10/1985 | Sachdev et al. | 400/241.1 |
| 4,587,198 | 5/1986 | Fisch | 430/201 |
| 4,588,315 | 5/1986 | Seto et al. | 400/120 |
| 4,599,298 | 7/1986 | Fisch | 430/271 |
| 4,657,840 | 4/1987 | Fisch | 430/201 |
| 4,705,739 | 11/1987 | Fisch | 430/276 |
| 5,084,330 | 1/1992 | Koshizuka et al. | 428/212 |

OTHER PUBLICATIONS

Society of Photographic Science & Engineering (SPSE) Conference on "Non-impact Printing Technologies", Aug. 1986.

Tagushi et al. of Matsushita, Society of Photographic Science & Engineering (SPSE) Conference, Aug. 1986.

Debe and Poirier, "Effect of Gravity on Copper Phthalocyanine Thin Films III: Microstructure Comparisons of Copper Phthalocyanine Thin Films Grown in Microgravity and Unit Gravity", Thin Solid Films, 186 (1990) pp. 327-347.

Zurong et al., "Kexue Tongbao", vol. 29, p. 280 (1984).

*Primary Examiner*—B. Hamilton Hess
*Assistant Examiner*—W. Krynski
*Attorney, Agent, or Firm*—Gary L. Griswold; Walter N. Kirn; Carolyn V. Peters

[57] ABSTRACT

An imaging film donor sheet comprising a substrate, a controlled release/adhesive layer and a vapor-deposited colorant layer, wherein the deposited colorant layer exhibit a discernible microstructure, preferably a columnar microstructure. A matching receptor sheet is provided. A method of preparing the donor sheet as well as a method of imaging is provided.

17 Claims, 3 Drawing Sheets

VAPOR DEPOSITED MULTI-LAYERED FILMS—A METHOD OF PREPARATION AND USE IN IMAGING

BACKGROUND OF THE PRESENT INVENTION

1. Field of the Invention

This invention relates to multi-layered films, their preparation, and their uses in thermal printing. More particularly, this invention relates to films comprising a substrate and a vapor-deposited colorant layer; to a method of thermal image printing utilizing a donor sheet comprising a substrate, a vapor-deposited colorant layer and a controlled release adhesive layer, and a matching receptor sheet; to a method of imaging; and to a coating process.

2. Description of the Related Art

The technology of thermal pigment transfer systems can generally be divided into two fields, mass transfer and dye sublimation transfer. Thermal imaging technology has been progressing rapidly in the last couple of years, especially in the areas of thermal dye transfer.

The term mass transfer is used to refer to systems in which both the color pigment and its binder are transferred from a donor sheet to a receptor sheet (or intermediate carrier sheet). Because of the relatively large size of the transferred material, a particle comprising both color pigment and binder, color gradation, that is, half-tone image tone is difficult to achieve. Furthermore, in the case of thermal dye transfer, where only dye molecules are transferred through the boundary, extended gradation cannot be achieved. However, dye transfer images generally exhibit more limited aging stability than do color pigments. Additionally, the high energy requirements of 6–10 joules/square centimeters ($J/cm^2$) in order to achieve thermal dye transfer has been problematic.

While the capabilities of thermal mass transfer printing equipment have improved, the progress of dot growth printing beyond 16 gray levels/pixel has been slow. There is no commercially available matching media that has the resolution capabilities to match the capabilities of printer hardware. Additionally, heat drag problems associated with prolonged printing of printer heating elements can cause uncontrollable dot growth. The low gray level capability of available media, coupled with the difficulty of heat drag control reduces the utility of dot-growth thermal mass transfer technology in graphic arts applications.

Various attempts have been made to eliminate or reduce the limitations described herein above. In the mass transfer area, improvements lie primarily in the design and thermal control of the print head.

This approach was described by S. Maruno of Matsushita Elec. Inc. Co., Ltd. in a paper presented to the August (1986) Society of Photographic Science & Engineering (SPSE) Conference on Non-impact Printing Technologies. "Thermo-convergent ink transfer printing" (TCIP) is described as a system in which the shape of the heating elements of the print head are optimized and the energy pulses to the head are controlled so that continuous tone reproduction is improved when wax-color pigment donor sheets are used.

The donor sheet, itself, has been a subject of improvement work. Japanese Kokai No. 59-224394 discloses the use of two incompatible binders in which the dye is dissolved. This results in the mass transfer of relatively small particles of color pigment. Combining this donor sheet with good print head control has been known to result in a low level of color gradation.

The use of one resin and color pigment in the donor sheet and a different resin in the receptor sheet has been described in a paper by Tagushi et al. of Matsushita given at the SPSE Conference (August, 1986). The modulated thermal signal in the print head causes changes in the "melt, compatibility, adhesion and transfer between the two resins," thereby producing a continually graduated print.

Other examples of improved mass thermal transfer of wax/color pigment systems include: (a) donor sheets incorporating conductive/resistive layer pairs in their constructions and described in U.S. Pat. Nos. 4,470,714 and 4,588,315; and (b) donor sheets containing exothermic materials to amplify the energy provided by the print head and described in U.S. Pat. Nos. 4,491,432 and 4,549,824.

Media using colored dyes and color pigments are used in a wide variety of imaging processes and graphic arts applications. Various technologies, such as color photography, diazonium salt coupling, lithographic and relief painting, dye-bleach color photocopying and photosensitive imaging systems may use dyes or color pigments to form an observable color image. Examples of some of these types of technologies may be found for example in, U.S. Pat. Nos. 3,136,637, 3,671,236, 4,307,182, 4,262,087, 4,230,789, 4,212,936, and 4,336,323. In these systems, the dye or color pigment is present in a carrier medium such as a solvent or a polymeric binder. In the transfer of dyes by sublimation, it has generally been only the final image that consists of essentially pure dye on a receptor sheet. Each of these various imaging technologies has its various complexity, consistency, image quality, speed, stability and expense.

U.S. Pat. No. 4,268,541 describes a method that deposits organic protective layers onto vapor-deposited metal layers. Amongst the organic materials deposited are Rhodamine B and phthalocyanine, a dye and a color pigment. These materials are not described as actively involved in any imaging process.

U.S. Pat. No. 4,271,256 shows image transfer processes using vapor-deposited organic materials, including dyes, where the transfer is made by stripping the image off a substrate with an adhesive film. The reference also discloses the use of dyes under a vapor-coated metal layer to enhance radiation absorption, but does not use a photoresist with the article.

U.S. Pat. No. 3,822,122 describes irradiation of a dye layer (which may have been vapor-deposited) to oxidize or otherwise decolorize the dye and leave an image which can then be transferred to a receptor surface.

U.S. Pat. No. 3,811,884 discloses an image transfer process wherein a layer of organic coloring material is irradiated to color, discolor or fade the material so that the remaining dye image can be transferred by heating.

U.S. Pat. No. 4,587,198 discloses a process for generating a color image comprising exposing a radiation sensitive layer over a vapor-deposited dye or color pigment layer and vaporizing the dye or color pigment to selectively transmit the dye or color pigment through the exposed layer.

U.S. Pat. No. 4,599,298 discloses a radiation sensitive article comprising a substrate, a vapor-deposited dye or color pigment layer capable of providing an optical density of at least 0.3 to a 10 nm band of the EM spectrum between 280 and 900 nm and a vapor-deposited graded metal/-metal oxide or metal sulfide layer. U.S. Pat. No. 4,657,840 discloses a process for producing the article of U.S. Pat. No. 4,599,298.

U.S. Pat. No. 4,705,739 discloses several graphic arts constructions similar to those disclosed in U.S. Pat. Nos. 4,587,198, 4,599,298, and 4,657,840. The constructions disclosed contain an overlaying photosensitive resist layer that must be exposed and developed to obtain an image.

Microstructural and physical properties of vapor-deposited films can depend on deposition conditions, such conditions include (1) substrate temperature, (2) deposition rate, which is a function of the evaporation source temperature, source-to-substrate distance ($d_{ss}$), substrate temperature, (3) deposition angles, (4) characteristics of the substrate, and (5) chamber pressure, see for example, Debe and Poirier, *Effect of Gravity on Copper Phthalocyanine Thin Films III: Microstructure Comparisons of Copper Phthalocyanine Thin Films Grown in Microgravity and Unit Gravity*, Thin Solid Films, 186(1990) 327-347. Thin layers of colorants materials, including CuPc, vapor-deposited at critical substrate temperature generally tend to be smooth and densely packed, and thin layers of vapor-deposited CuPc by physical transport mechanism have been known to show a columnar structure. However, columnar orientation of the vapor-deposited colorant depends on the incident CuPc beam direction during deposition, see Zurong et al., *Kexue Tongbao*, vol. 29, pg. 280 (1984), which discloses deposition of a colorant layer on a stationary substrate.

In addition to the problems involved in producing low transfer energy, high resolution, and color images, it is essential to utilize a neutral black "color" donor sheet. The neutral black "color" donor sheet should exhibit properties comparable to those of the colorant donor sheets. Conventional carbon black dispersion coating generally can not deliver high resolution. Carbon black vapor coating is generally not considered because of the high melting point (~3700° C.) of carbon.

Although most or all of these attempts have been successful to some extent, none has given the desired combination of low transfer energy, high resolution, and full color, continuous half tone images of excellent image color stability, using yellow, magenta, cyan and black (YMCK).

SUMMARY OF THE INVENTION

Briefly, the present invention provides an imaging film comprising in successive layers, (a) a substrate, (b) a controlled release/adhesive layer, and a colorant layer on the surface of the substrate wherein the colorant layer comprises at least a single layer of vapor deposited colorant having a columnar microstructure. Optionally, a thermoplastic adhesive layer is deposited on the colorant layer. A matching receptor sheet is also provided comprising a substrate and the same controlled release-/adhesive layer as used in the donor sheet.

The colorant layer comprises low cohesive, columnar microstructures. Advantageously, the colorant layer of columnar microstructures offers higher transparency, higher resolution capabilities, higher color saturation and larger color gamut coverage than conventional thermal transfer media. Further, the columnar microstructures of the color enable a higher degree of dot growth capability within a printer pixel to generate a large range of gradation at a relatively low energy of ~1.6 J/cm$^2$.

The colorant layer exhibits an adhesive force to the substrate that is low enough for transfer but high enough for handling. The colorant layer has a cohesive force within the layer that is strong enough for 100% transfer, that is to separation at the colorant layer-substrate interface, but weak enough so that the transfer image has sharp edges, that is, to separate within the layer. When a controlled release/adhesive layer is present, separation under printing conditions, generally occurs at the controlled release/adhesive layer-substrate interface.

The controlled release/adhesive layer is a mixture of two or more thermoplastic polymers or resins, and may be applied by processes known to those skilled in the art, such as by knife coating, bar coating, and solvent coating.

Further, the colorant layer may be a single color, such as yellow, magenta, or cyan, or may be a two-color combination, such as yellow-magenta, yellow-cyan, or magenta-cyan, or a combination of yellow, magenta, and cyan.

An alternative embodiment of the present invention provides a multilayered donor sheet comprising a substrate, a 100% solids colorant layer (containing 0% binders or solvents), and optionally a thermoplastic layer is deposited over the colorant layer. The donor sheet provides at least for one of the three primary colors of yellow, magenta, and cyan (YMC) separately or any combination thereof. A matching receptor sheet comprises a substrate and a thermoplastic layer the same as the thermoplastic layer deposited on the donor sheet.

The optional thermoplastic layer may be applied by processes known to those skilled in the art, such as vapor coated or solution coated.

In another aspect, a process is provided for vapor-deposition of a colorant layer comprising the steps:

(1) purifying the colorant, wherein the purifying step includes vacuum sublimation of the colorant;
(2) condensing the sublimed colorant on a temperature gradient surface; and
(3) depositing, in a vacuum chamber, the condensed colorant onto a moving substrate.

Optionally, the process further includes coating a thermoplastic layer onto the surface of colorant layer.

In yet another aspect, the present invention provides a neutral black donor sheet comprising a substrate, a black neutral layer, and a controlled release layer deposited between the substrate and the black neutral layer.

In another aspect of the present invention, a process is provided for making a neutral black donor sheet comprising:

(1) coating a substrate with a controlled release/adhesive layer;
(2) introducing the coated substrate into a coating chamber;
(3) introducing vaporized magenta, cyan and yellow prepurified colorants into the coating chamber such that the colorants are mixed prior to or during deposition; and
(4) depositing a thin layer of the mixed colorants onto the coated substrate.

Alternatively, a neutral black color could be obtained by, depositing a thin layer of each of magenta, cyan and yellow colorant sequentially, in any sequence.

Colorant donor sheets and neutral black donor sheets of the present invention are useful for generating high quality, uniform graphic images including alphanumeric images add-ons for short run signs, high quality color overhead projection (OHP) transparencies, color hardcopy and color transfergraphics.

Receptor sheets are useful as displaying high quality color overhead projection transparencies, short run signs, color hardcopy and color transfer graphics.

Another aspect of the present invention provides a method of imaging comprising the steps:

(1) bringing a first multi-layered donor sheet, colorant side facing and in contact with a matched receptor sheet, wherein the first multi-layered donor sheet comprises sequentially, a substrate, a controlled release/adhesive layer, and a colorant layer;

(2) applying thermal energy in an imagewise fashion with a thermal printer head to the side of the substrate opposite to the color pigment layer;

(3) separating the first donor sheet from the receptor sheet; and (4) optionally, repeating steps 1 to 3 inclusively while using the same receptor sheet with a second donor sheet, a third donor sheet, and a fourth donor sheet, wherein said first, second, third, and fourth donor sheet are coated with a different single colorant, such as cyan, yellow, magenta, and black.

In this application:

"colorant" means any substance or mixture that imparts color to another material, and may either be dyes or pigments. The term "colorant" applies to black and white as well as to actual colors;

"controlled release/adhesive" refers to a material that comprises a first component and optionally, a second component, each of which are polymers or resins, a material that is nontacky at room temperature, that is, about 25° C. and a material that, under imaging conditions, has a greater adhesive affinity for the colorant than for the substrate that is, separation of the layers occurs at the controlled release-/adhesive substrate interface;

"compatible polymers or resins" refers to an organic material that under imaging conditions, has a greater adhesive affinity for the substrate than does the incompatible polymer or resin;

"incompatible polymer or resin" refers to an organic material that under imaging conditions, has a greater adhesive affinity for the colorant than does the compatible polymer or resin;

"adhesive affinity" means the tendency of one material to adhere to another material; and "tacky" when used in reference to a material means the material is at least slightly adhesive with respect to another material in which it is in contact.

(a) is the donor/receptor combination before a colorant layer is transferred; and (b) is the donor/receptor combination after a colorant layer is transferred from the donor to the receptor sheet.

Figure 4A:
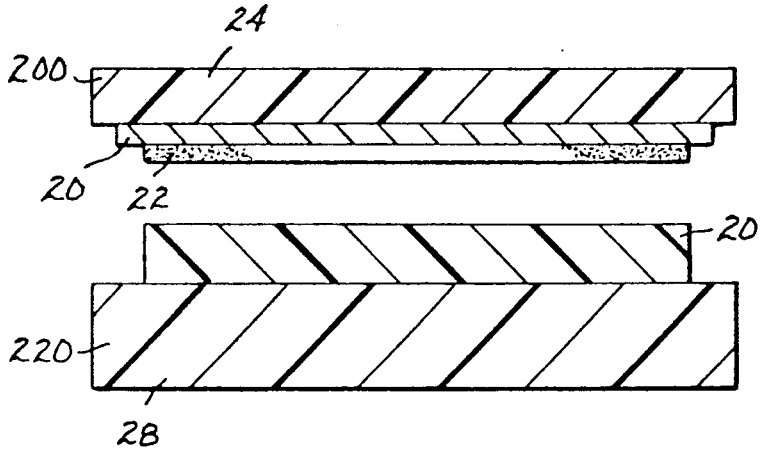
Figure 4B:
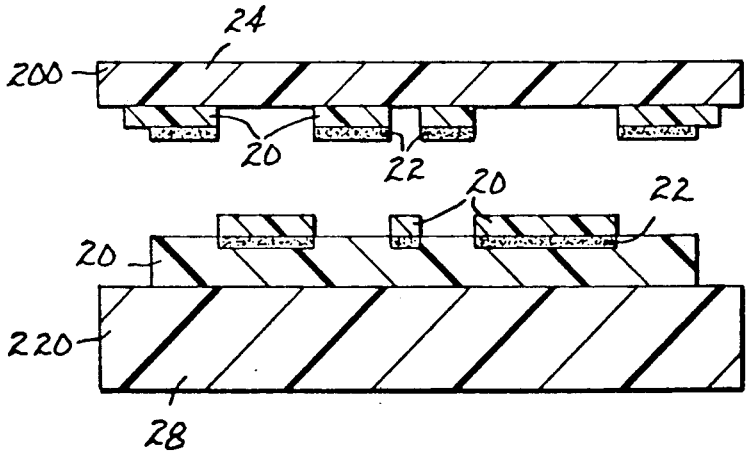

FIGS. 4 (*a*) and (*b*) are cross-sectional views of the donor/receptor combinations of the present invention:

(a) is the donor/receptor combination before a colorant layer is transferred; and (b) is the donor/receptor combination after a colorant layer is transferred from the donor to the receptor sheet.

DETAILED DESCRIPTION OF THE PREFERRED EMBODIMENT

This invention relates to colorant films, a method of preparation and their use in thermal printing, and more particularly to films comprising a substrate and a vapor deposited colorant.

The present invention provides a donor sheet comprising:

a substrate;

a controlled release/adhesive layer; and a vapor-deposited colorant layer. The colorant layer being capable of providing an optical density of at least 0.3, preferably at least 1.0 and has a columnar microstructure.

The article of the present invention may optionally comprise a thermoplastic layer coated onto the colorant layer. Preferably, a receptor sheet comprising a substrate and a controlled release/adhesive layer and is matched to the donor sheet, such that the controller release/adhesive of the receptor sheet is physically or chemically similar to the controlled release/adhesive layer of the donor sheet.

Suitable substrates for the donor sheet for use in the present invention are substrates that are rough or smooth, transparent or opaque, flexible or rigid, and non-porous or porous. The substrate may be fabricated from natural or synthetic polymeric resins (thermoplastic or thermoset), ceramic, glass, metal, paper, and fabric. For most commercial purposes, suitable substrates include but are not limited to a polymeric resin such as polyester, (polyethylene terephthalate, which may be biaxially stabilized), cellulose papers, polycarbonate, polyvinyl resins, polyamide, polyimide, polyacrylates, polyethylene naphthalate, polysulfones, and polyolefin. The substrate may contain fillers such as carbon black, titania, zinc oxide, dyes, and may be treated or coated with those materials generally used in the formation of films such as coating aids, lubricants, antioxidants, ultraviolet radiation absorbers, surfactants, and catalysts. As such, the substrate may comprise any number of layers as required for coating aids, lubricants, antioxidants, ultraviolet radiation absorbers, surfactants, antistats, and catalysts. The preferred substrate is polyethylene terephthalate, (available, for example, from DuPont). The substrate generally has a thickness of 1-12 micrometers, with less than or equal to 6 micrometers being preferred.

The substrate of the colorant receptor sheet can be made of any flexible material to which an image receptive layer can be adhered. Suitable substrates for use in practice of the present invention include substrates that are smooth or rough, transparent, opaque, and continuous or sheetlike. They are essentially non-porous. A preferred substrate is white-filled or transparent polyethylene terephthalate or opaque paper. Representative examples of materials that are suitable for the substrate include polyesters, especially polyethylene terephthalate, polyethylene naphthalate, polysulphones, polystyrenes, polycarbonate, polyimide, polyamide, cellulose esters, such as cellulose acetate and cellulose butyrate, polyvinyl chlorides and derivatives. The substrate may also be reflective such as baryta-coated paper, an ivory paper, a condenser paper, or synthetic paper. The substrate generally has a thickness of 0.05 to 5 mm, with greater than 0.05 mm to 1 mm preferred. Typically, a donor article may be in the form of a printer ribbon.

By "non-porous" in the description of the present invention it is meant that ink, paints and other liquid coloring media will not readily flow through the substrate (for example, less than 0.05 $cm^3.sec^{-1}$ at $9.3\times10^2$ Pascals (7 mm Hg) pressure, preferably less than 0.02 $cm^3.sec^{-1}$ at $9.3\times10^2$ Pa pressure). The lack of significant porosity prevents absorption of the heated transfer layer into the substrate and prevents uneven heating through the substrate.

Addition of a controlled release/adhesive (CR/A) layer between the substrate and a colorant layer facilitates an easy and controllable imagewise transfer of the colorant layer from a donor sheet to a receptor sheet. This is particularly effective when the same CR/A mixture is coated onto the surface of a receptor sheet, that is, the surface facing the donor sheet. This overcomes the problem of dissimilar surface properties that are typically generated during a conventional overprinting process.

The CR/A is an admixture of two or more thermoplastic polymers or resins. At room temperature, the CR/A mixture is nontacky. However, under imaging conditions, at least one of the polymers or resins should have good adhesion affinity and while at least one of the polymers or resins should have poor adhesion affinity, both with respect to the donor substrate. The polymers or resins are blended together and conventionally coated onto a substrate prior to colorant vapor-deposition.

To maintain high transparency, the polymers or resins selected for the CR/A layer on both the donor sheet and the receptor sheet substrates should be compatible between themselves. This avoids phase separation that could cause light scattering, resulting in poor light transmission. The CR/A polymers or resins are selected so that during the imaging process, the CR/A layer is transferred to the receptor sheet when the colorant is transferred.

The polymer/polymer or polymer/resin CR/A coating comprises at least one compatible polymer and at least one incompatible polymer with respect to the donor substrate. A compatible polymer or resin has a greater adhesive affinity to the donor sheet or receptor sheet substrate than an incompatible polymer or resin, under imaging conditions. Thus, by varying the amounts of compatible and incompatible polymers or resins in the CR/A mixture, a CR/A layer of varying adhesive strength can be achieved.

Compatible polymers and resins include, but are not limited to aqueous polymers, such as polyethyloxazoline (available under the trade designation "PEOX", for example PEOX TM 50, PEOX TM 200, Dow Chemical Co.), sulfonated polyethylene terephthalate (available under the trade designation "Viking Polymer", 3M Co.) organic soluble polymers, such as vinyl acetate; and latexes, such as, acrylic resins, polyvinyl acetate (available under the trade designation "E335", DeSoto), vinyl acrylic (available under the trade designation "Unocal", Union Oil Co.), aqueous dispersion of acrylic copolymers (available under the trade designation "Rhoplex", Rohm & Haas Co.), Acrysol TM colloidal dispersion (available from Rohm & Haas Co.), vinyl acetate, vinyl acetate/acrylate emulsion (available under the trade designation "Wallpol", Reichhold Chemicals, Inc.), and thermoplastic polyethylene terephthalate (available under the trade designations "PE222" and "VPE 5833", Goodyear Tire & Rubber Co.).

Incompatible polymers and resins include, but are not limited to, water soluble polymers, as acrylic resins (available under the trade designation "Carboset", Goodyear Tire & Rubber, Co.), polyvinyl alcohol (PVA), polyvinyl pyrrolidone (PVP); organic solvent soluble polymers, such as polyacrylic acid (Elvacite TM 225P, DuPont de Nemours, E.I., Co.); fatty acids polymers, such as myristic acid polymers; Staybelite TM ester (Hercules Inc.), polyethylene (available under the trade designation "Piccolastic", Hercules Inc.); resins, such as Dymerex TM resin (Hercules Inc.); waxes, such as chlorinated paraffin wax, carnauba, shell, multiwaxes, and beeswax; and latexes, such as ethylene acrylic acid (EAA) (Morton Chemical Co.).

The combination of compatible and incompatible polymers or resins for the CR/A layer is dependent upon the substrate selected and generally has a volume % ratio in the range of greater than 0 to less than 100 and less than 100 to greater than 0, preferably a volume % ratio in the range of 20:80 to 80:20, more preferably in the range of 30:70 to 70:30. Furthermore, the compatible and/or incompatible polymers or resins maybe a mixture of polymers or resins. A preferred CR/A layer for overprinting applications is a mixture of VPE TM 5833, PE 222, and Staybelite TM ester in the ratio of 70:0:30 or 40:30:30. The thickness of the CR/A layer on a donor sheet in a preferred embodiment is in the range of 0.1 to 1 μm, preferred thickness is in the range of 0.1 to 0.5 μm, more preferred thickness is in the range of 0.2 to 0.4 μm. The CR/A layer thickness on a matching receptor sheet is a preferred embodiment and preferably is in the range of greater than 0 to 10 μm, and more preferably, 1 to 8 μm.

The vapor-deposited colorant layer for yellow, magenta, and cyan is coated in sufficient thickness so as to provide a transmission optical density (TOD) typically of at least 0.3 as measured by MacBeth Model TD 527 densitometer (MacBeth Instruments Co., Newburgh, NY). Colorants from any chemical class that may be vapor-deposited, that is, do not decompose upon heating, and exhibit a discernible microstructure may be used in the practice of the present invention. The colorant preferably exhibits good uniformity, high transparency, excellent color saturation and wide color gamut, good gray levels and high resolutions capability, thermal stability and lightfastness. Furthermore, the colorants should provide a uniform coating on substrates, in the range of greater than zero cm to at least 100 cm wide.

Colorants suitable for use in the present invention include, but are not limited to methines, anthraquinones, oxazines, azines, thiazines, cyanines, merocyanines, phthalocyanines, indamines, triarylmethanes, benzylidenes, azos, monoazones, xanthenes, indigoids, oxonols, phenols, naphthols, pyrazolones, etc. The thickness of the colorant layer depends upon the colorant used and need only be thick enough to provide at least the minimum optical density. As a result, a vapor-deposited layer of colorant may be as thin as a few tens of nanometers or as thick as several micrometers, for example 10 to 1000 nm thick, preferably 50–500 nm, and more preferably 100–400 nm thick.

Colorants are typically pre-purified prior to vapor-deposition onto a substrate. Purified colorants, for example, copper phthalocyanines (CuPc), Pigment Violet 19 (PV19), and (3,5-dimethyl) DY-11 isomer vaporize with little or no decomposed product left in the heating means, providing the source temperature is kept below the decomposition temperature of the colorant. Advantageously, the deposition rate of a purified colorant onto a substrate is more controllable than an unpurified colorant. Furthermore, the coating properties are more uniform and generally provide a distinguishable columnar microstructure.

Purification of the colorant may take place in the presence of an inert gas, such as argon or in the absence of an inert gas. When operating under an inert gas, the container is typically maintained at a reduced pressure in for example, the range of $1.3\times10^{2}$ to $6.6\times10^{2}$ Pa (1 to 5 Torr). When the purifying step occurs in the absence of an inert gas, the pressure in the container is maintained in the range of $6.6\times10^{-1}$ to $1.3\times10^{-4}$ Pa ($5\times10^{-3}$ to $1\times10^{-6}$ Torr).

Unpurified colorant is placed in a container and heated to a sublimation temperature that is just below the decomposition temperature at the operating conditions of the purifier. This sublimation temperature depends on the colorant chosen and is typically in the range of 200° to 550° C. Colorants, having higher vapor pressure (than the pressure of the vacuum chamber) at the same temperature will condense and deposit on a temperature gradient container at the cooler zones. The unpurified material is generally positioned at the hottest zone in the heating means. Pure colorant, which usually has the lowest vapor pressure, is deposited at a cooler zone not far away from the unpurified material. Deposited colorant nearer to the unpurified material tends to be larger in crystalline size and eventually becomes smaller as the distance from the hottest zone increases. Higher vapor pressure impurities are deposited at the coolest zones, that is, near the end of the heating means. The larger the vapor pressure difference between the pure colorant and the impurities, the better the separation. Table 1 summarizes the conditions at which several different colorant may be purified.

TABLE 1

Summary of Purification Conditions of Different Organic Color Pigments

| Color Pigment | Temperature (°C.) | Pressure (Pascal) |
|---|---|---|
| CuPc | 350–550 | $6.6\times10^{-1}$ $1.3\times10^{2}$ to $2.6\times10^{2}$ (under inert gas) |
| PV19 | 300–475 | $6.6\times10^{-1}$ $1.3\times10^{2}$ to $2.6\times10^{2}$ (under inert gas) |
| (3,5-dimethyl) DY11 isomer | 200–300 | $6.6\times10^{-1}$ $1.3\times10^{2}$ to $2.6\times10^{2}$ (under inert gas) |

A process of the present invention for vapor deposition of a single colorant onto a substrate comprises:

(1) loading one of a pre-purified yellow, magenta, or cyan colorant into an evaporation means;

(2) reducing the pressure of the coating means to the range of $10.6\times10^{-2}$ to $1.3\times10^{-5}$ Pa ($8\times10^{-4}$ to $1\times10^{-7}$ Torr);

(3) raising the temperature of the evaporation means such that the purified colorant is vaporized; and (4) depositing the vaporized colorant onto a substrate, wherein said substrate is moving at a rate in the range of 0 to 50 meters/min (m/min), preferably greater than 0 to 50 m/min, more preferably 0.1 m/min to 50 m/min.

A process of the present invention for vapor deposition of a two-colorant layer onto a substrate comprises:

(1) loading a mixture of two of pre-purified yellow, magenta, or cyan colorant into an evaporation means;

(2) reducing the pressure of the coating means to the range of $10.6\times10^{-2}$ to $1.3\times10^{-5}$ Pa ($8\times10^{-4}$ to $1\times10^{-7}$ Torr);

(3) raising the temperature of the evaporation means such that the purified colorant mixture is vaporized; and (4) depositing the vaporized colorant mixture onto a substrate, wherein said substrate is moving at a rate in the range of 0 to 50 meters/min (m/min), preferably greater than 0 to 50 m/min, more preferably 0.1 m/min to 50 m/min.

Alternatively, load-up two of the pre-purified yellow, magenta, or cyan colorants into two independently heated evaporation means, and deposit simultaneously.

A process of the present invention for vapor deposition of black colorant onto a substrate comprises:

(1) loading a mixture of pre-purified yellow, magenta, or cyan colorant into an evaporation means;

(2) reducing the pressure of the coating means to the range of $10.6\times10^{-2}$ to $1.3\times10^{-5}$ Pa ($8\times10^{-4}$ to $1\times10^{-7}$ Torr);

(3) raising the temperature of the evaporation means such that the purified colorant mixture is vaporized; and (4) depositing the vaporized colorant mixture onto a substrate, wherein said substrate is moving at a rate in the range of 0 to 50 meters/min (m/min), preferably greater than 0 to 50 m/min, more preferably 0.1 m/min to 50 m/min.

The three colors, yellow, magenta and cyan may be applied sequentially, in any sequence to produce a black colorant donor sheet or may be independently heated in three separate heaters and deposited simultaneously.

Optionally, a black colorant may be prepared by a process for producing a neutral black "color" as taught in U.S. Pat. No. 4,430,366 (Crawford et al.), and the description of such process is incorporated herein by reference and comprises applying onto at least one surface of a substrate the components of mixture of metal and metal oxide from a metal vapor stream into which stream is introduced a controlled amount of oxygen.

Prior to depositing the metal and metal oxide mixture, that is, the neutral black color, a release layer is applied to the substrate. The black aluminum oxide deposited on the controlled release layer exhibits columnar microstructures similar to those of the vapor-deposited colorant layer. For example, as described in co-pending application, U.S. Ser. No. 07/776,602, entitled "Coated Thin Film For Imaging," filed Oct. 11, 1991, the release coat comprises an inorganic particle or an admixture of an inorganic particle and an organic binder.

Materials useful as the inorganic particles of the release layer include, but are not limited to aluminum monohydrate or boehmite particles (Dispersal TM particles, Condea Chemia, GmBH, Hamburg, Germany or Catapal D TM particles, Vista Chemical Co.), hydrophobic $SiO_2$ particles (Tullanox TM particles, Tulcon, Inc.), titania particles, zirconia particles, graphite particles, and carbon particles.

The coating means that can be used in the practice of this invention are conventionally known vacuum coaters. Two illustrative examples are described, but this should not be construed to limit the scope of the present invention. An example of a coater for small scale production is a 30 cm glass bell jar operated under high vacuum. The system is equipped with an oil diffusion pump and a substrate drive capable of handling substrates up to 15.2 cm wide. The substrate drive comprises a supply roll, a pick-up roll and a dc motor having a maximum speed in the range of 0.46 meters/min.

Figure 2:
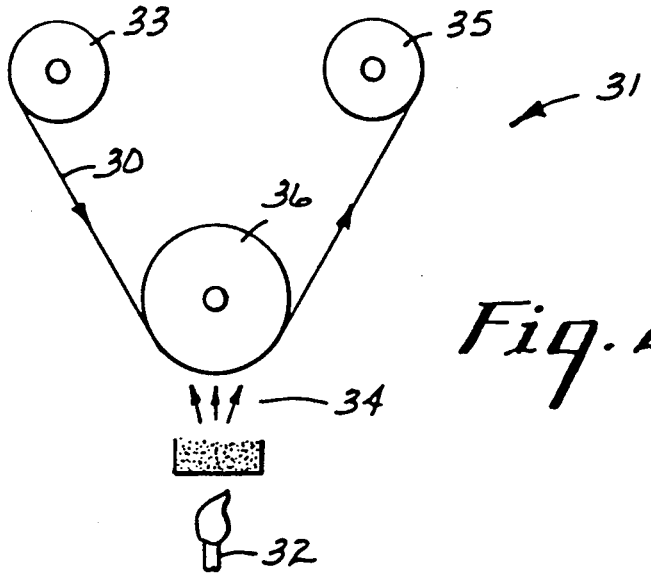
FIG. 2 is a schematic represenation of the coating process of the present invention.

Referring to FIG. 2, a large scale production coating system is illustrated. A schematic representation of a vacuum coating system 31 is equipped with a cryopump (not shown), a heating means 32 and a substrate drive (not shown) can be used. The cryopump should be capable of obtaining pressures down to $6.6\times10^{-6}$ Pa ($5\times10^{-8}$ Torr). The substrate drive typically accommodates both 15.2 cm and 28 cm wide substrates 30 and comprises a substrate drive roll 36 with a coolant inlet (not shown) and outlet (not shown) such that the substrate 30 can be cooled or heated during coating, a supply roll 33, and a pick-up roll 35, both of which can be driven by torque motors to control the tension of the substrate 30. The larger substrate drive should be able to maintain a speed in the range of 10.8 m/min.

An example of an evaporation means that may be used in the practice of the present invention comprises a colorant material container, an inner heater and an outer heater. Evaporation means is typically fabricated from stainless steel sheet metal of 6 mil thickness. Evaporation means used to practice the present invention should be relatively light weight and able to provide improved response time and temperature regulation versus a heavier massive heater. Separate heating elements are independent from one another and provide for better control of the colorant material temperature and coating process. Since the colorant material in the heating means does not "see" the substrate directly, a well-known problem of high rate deposition, known as "spitting" is minimized. The collimator-like heater has the effect of collimating the vapor flux incident upon the substrate, thus improving the efficiency of utilizing the colorant material for coating purposes and minimizes down time of the equipment, due to clean up.

Referring again to FIG. 2 a schematic representation of a coating system used for making the donor sheets of the present invention. In contrast to Zurong et al., the substrate 30 in the present invention continuously moves across a stationary heating means 32. The direction of the incident colorant vapor beam 34 with respect to the substrate 30 is controllable, that is constant or continuously varied within a wide range. The coating layers of colorant are prepared in such a manner that the direction of the incident colorant vapor beam 34 can be varied continuously within a range of $-60°$ to $+60°$ or narrower. Resulting columnar structures of the colorant layer are typically perpendicular to the substrate. Donor sheets can be prepared by vapor-depositing single colors, such as yellow, magenta, or cyan to produce primary color donor sheets, two-color mixtures, such as yellow-cyan, yellow-magenta, or magenta-cyan to produce secondary color donor sheets, or three-colors, to produce a black color donor sheet. An alternative process to generate a neutral black color using black aluminum oxide is described hereinbelow.

Figure 1:
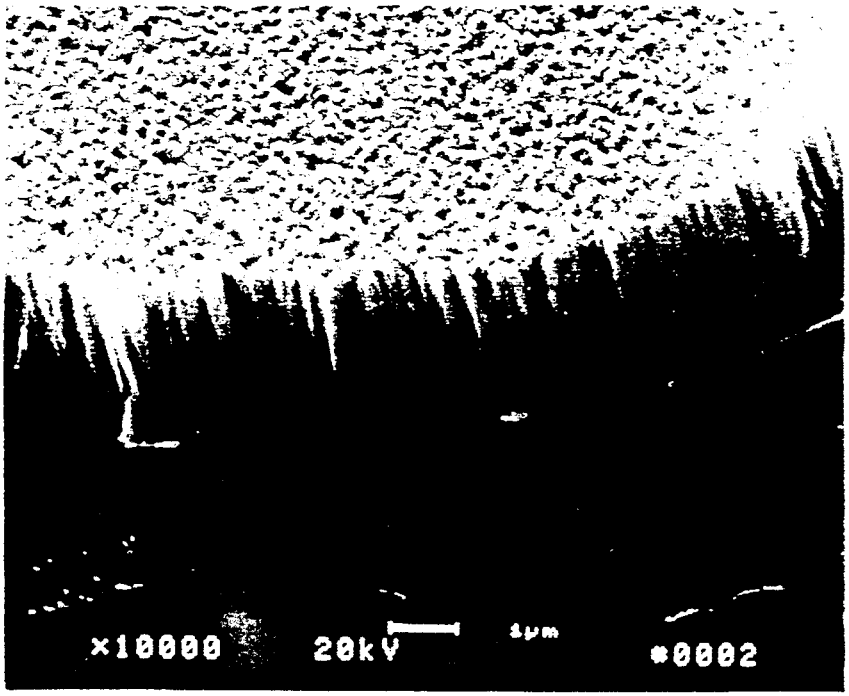
FIG. 1 is a scanning electron micrograph (SEM) of the columnar microstructure of the vapor-deposited copper phthalocyanine.

A vapor-deposited colorant layer comprises a single layer of columnar microstructures, as illustrated in FIG. 1. The single layer of colorant coating exhibit anisotropic cohesive forces. For example, the low cohesive force between individual columns of the colorant layer and the high cohesive force within each column enables transfer of a whole column cleanly without breaking the column anywhere in between. The columnar microstructure enables higher degree of dot growth capability within a printer pixel to generate a large range of gradation at a relatively low energy of 1.6 $J/cm^2$.

The columnar microstructure of the colorant layer enables higher resolution image than conventional transfer media. This is primarily due to the unique structures. The microstructures have low adhesion and cohesion and theoretically the colorant could be transferred from a donor sheet to a receptor sheet one column at a time. The present films typically have a microstructure density of approximately 2500 columns per 5 micrometer ($\mu$m) dot. The height of the microstructure is the thickness of the colorant layer, which is in the range of 10 to 1000 nm thick.

Furthermore, the columnar microstructure of the colorant offers higher transparency, higher resolution capability, higher color saturation, and greater color gamut coverage than current conventional thermal transfer media. The transparency of the prepurified vapor-deposited crystalline colorants offers transparencies that are matched or even exceeded by noncrystalline dyes, the crystallized colorants are distinctly advantageous over noncrystalline dyes, that is, the colorants are lightfast, wherein the noncrystalline dyes tend to fade due to extended exposure to light.

High color saturation results from low light scattering and high optical density at relatively thin thickness. The low light scattering is due to the prepurification of the colorant prior deposition and "single composition" layer of columnar microstructure colorant. The prepurification step eliminates all or essentially all impurities that can effect light scattering.

In order for a dot to be transferred, adhesion forces $f_1$, $f_2$ and the cohesion force $f_3$ should satisfy the following relationship:

$$f_2 \geqq f_1 + f_3(2d/r)$$

wherein $f_1$ is the adhesion force/unit area between the colorant layer and the donor sheet substrate, $f_2$ is the adhesion force/unit area between the colorant layer and the receptor substrate, $f_3$ is the cohesion force/unit area within the colorant layer, r is the radius of the colorant to be transferred and d is the thickness of the colorant layer. Since $f_3$ and d are functions of the colorant layer only and generally are not affected by printing conditions. On the other hand $f_1$, $f_2$ and r are affected by printing conditions. For any given printing condition, $f_3$ is independent of the receptor surface, where as the magnitude of $f_2$ changes with different receptor surfaces. The differences in receptor surfaces can directly affect the radius or the dot size.

Figure 3A:
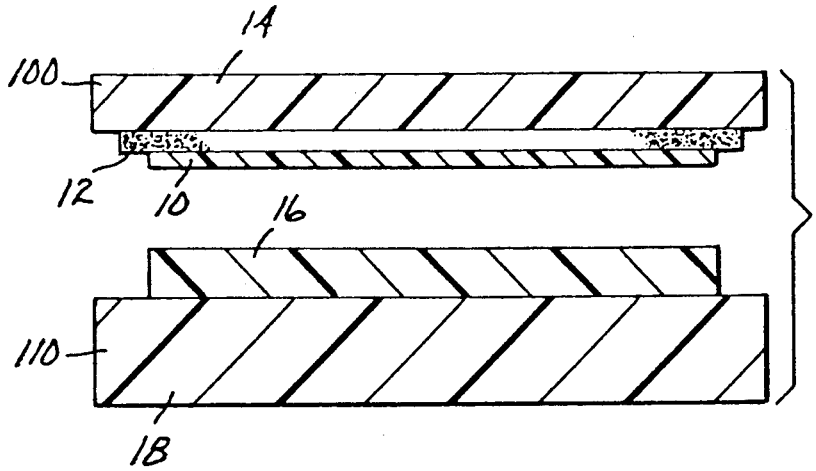
Fig. 3a PRIOR ART
FIGS. 3 (*a*) and (*b*) are cross-sectional view of a conventional donor/receptor combination.
Figure 3B:
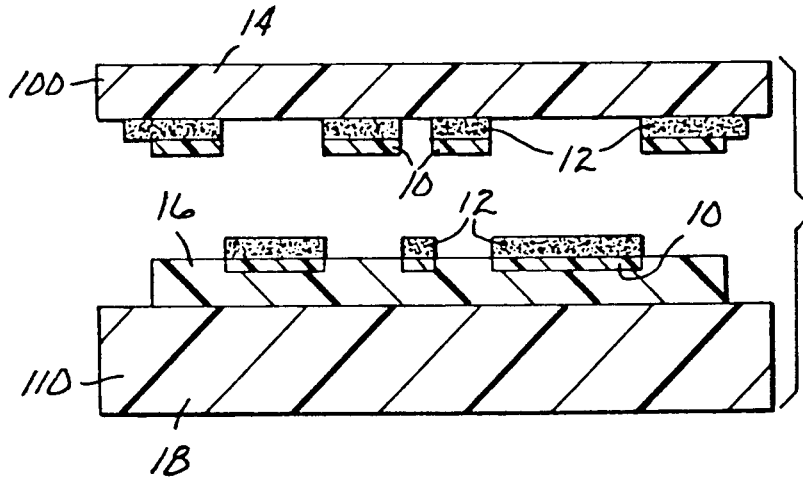
Fig. 3b PRIOR ART

In order to preserve a "single composition" layer, columnar microstructured colorant layer and its associated characteristics, a two-layer construction to enable overprinting of primary colors is described. Referring to FIGS. 3 (*a*) and (*b*), a conventional donor/receptor combination is illustrated. Donor sheet 100 comprises a colorant layer 12 deposited onto a substrate 14. Thermoplastic layer 10 is conventionally overcoated onto colorant layer 12. This allows imagewise transfer by means of a thermal printer head of one or more colors, successively onto the same receptor sheet 110 for a composite color image. Prior to imaging, the transferrable donor colorant layer "sees" a surface that is homogeneous to colorant layer 12. However, once colorant layer 12 is imagewise transferred from donor sheet 100 to receptor sheet 110, the surface of receptor sheet 110 is no longer similar to donor sheet 100. Thus a second transfer of colorant layer 12 to receptor sheet 110 could result in the transferred section adhering to two different surfaces on receptor sheet 110, that a second transferred section could lie over a portion of the original receptor sheet 110 surface and over a portion of a previously transferred section of colorant layer 12. The surface incompatibility that results after an image is transferred from donor sheet 100 to receptor sheet 110 is generally due to the nature of the transferred layer.

As illustrated in FIG. 3(*b*), an imagewise colorant layer 20 is transferred from donor sheet 100 to receptor sheet 110. Receptor sheet's 110 facing surface (that is, the surface facing the donor sheet) now has discrete areas of thermoplastic layer 16 and dicrete areas of colorant layer 12. Any subsequent transfer of colorant layer 12 would result in an overlap of the thermoplastic layer 16 and the previously transferred colorant layer 12. While this incompatibility of the surfaces is acceptable for low resolution color printing, identical or nearly identical surfaces after transfer of a colorant to a donor sheet is preferred for high resolution, precise dot-growth controlled printing. See FIG. 3 and the text referenced to FIGS. 4(*a*) and (*b*), infra.

Referring to FIGS. 4 (*a*) and (*b*), a donor/receptor combination of the present invention is illustrated. Donor sheet 200 comprises a colorant layer 22 deposited onto a substrate 24, precoated with a CR/A layer 20. Matching receptor sheet 220 comprises a substrate 28 overcoated with a CR/A layer 20, which is the same CR/A mixture as is coated on donor sheet 200. This allows transfer of the colors, successively onto the same receptor sheet 220 for a composite color image. Prior to imaging, the transferrable donor colorant layer "sees" a homogenous surface. Colorant layer 22 is imagewise transferred from donor sheet 200 to receptor sheet 220. In contrast to a convention donor/receptor combination, the surface of receptor sheet 220 is remains identical to donor sheet 200. Identical or nearly identical surfaces after transfer of a colorant to a donor sheet is preferred for high resolution, precise dot-growth controlled printing.

Referring to again to FIG. 4 (*b*), when successive colorant layers are transferred, the colorant layer "sees" a surface with the same surface properties across receptor sheet 220, as if no prior transfer have taken place. The successive transfer seeing donor sheet 200 and matching receptor sheet 220 is not hindered by previously transferred colorant layers except perhaps at the boundaries at the superposition of previously transferred images or between imaged and unimaged area.

However, even the boundaries between imaged and unimaged areas are not problematic. Typically, the total thickness of transferred layer 30, that is, colorant layer 22 and CR/A layer 20, is generally less than a micrometers thick (0.3–0.8 μm). The corresponding CR/A layer 20 on receptor sheet 220 is generally in the range of >0 to 25 μm, preferably in the range of >0 to 10 μm, and more preferably in the range of 1 to 8 μm. While not wanting to be bound by theory, it is believed that the thickness of the coated CR/A layer need only be a monolayer, wherein the thickness is determined by the smallest dimension of largest component, that is, molecule or particle, comprising the CR/A. Thicknesses substantially greater than about 25 micrometers tend to provide an image with poor resolution. CR/A layer 20, for both donor sheet 200 and receptor sheet 220, can be applied to substrate 24 or 28 using a variety of conventional coating processes. Such processes include, for example, extrusion coating, gravure coating, blade coating, spray coating, brush coating, dip coating, and spin coating. Typically, CR/A layer 20 is applied to substrate 24 or 28 by coating a solution, dispersion, or other coatable material comprising the CR/A or precursor(s) thereof.

Using the imaging film as described in FIGS. 4 (*a*) and (*b*) provides for high resolution image transfer, and as well as provides high clarity and high resolution overprinting, that is, the printing of more than one color, such that the colors may overlap one another in the finished print. Interestingly, the columnar microstructure of the colorant films provides for high resolution single color printing, even without the use of the CR/A between the substrate and the colorant layer. If an imaging film comprising only a substrate and the colorant layer having a columnar microstructure is used for overprinting, the color clarity at the overlapping colors will be less than that wherein the imaging film has the CR/A film between the substrate and the colorant layer.

A preferred method of imaging using the imaging film as described in FIGS. 4 (*a*) and (*b*) comprises the steps:

(1) bringing a first multi-layered donor sheet, colorant side facing and in contact with a matched receptor sheet, wherein the first multi-layered donor sheet comprises sequentially, a substrate, a controlled release/adhesive layer, and a colorant layer;

(2) applying thermal energy in an imagewise fashion with a thermal printer head to the side of the substrate opposite to the color pigment layer;

(3) separating the first donor sheet from the receptor sheet; and (4) optionally, repeating steps 1 to 3, inclusively while using the same receptor sheet with a second donor sheet, a third donor sheet, and a fourth donor sheet, wherein said first, second, third, and fourth donor sheet are coated with a different single colorant, such as cyan, yellow, magenta, and black.

It is also within the scope of the present invention that a method of imaging, generally for a single color application, advantageously uses the properties of the columnar microstructures. The method for single color imaging comprises the steps:

(1) bringing a first multi-layered donor sheet, colorant side facing and in contact with a matched receptor sheet, wherein the first multi-layered donor sheet comprises a substrate, and a colorant layer;

(2) applying thermal energy in an imagewise fashion with a thermal printer head to the side of the substrate opposite to the color pigment layer;

(3) separating the first donor sheet from the receptor sheet; and

Objects and advantages of this invention are further illustrated by the following examples, but the particular materials and amounts thereof recited in these examples, as well as other conditions and details, should not be construed to unduly limit this invention. All materials are commercially available unless otherwise stated or apparent. All imaging examples were made by transferring imagewise from a donor sheet to a receptor sheet using an experimental thermal printer Model II equipped with a 200 dpi oki thermal printer head (Model# DTH 6604E) available from Oki Electric Industrial Co. Ltd., Tokyo, Japan. Transmission optical density and transparency were measured using a MacBeth Model TR527 densitometer (MacBeth Instrument Co., Newburgh, NY).

EXAMPLES

Example 1

This example describes purification by vacuum sublimation of organic colorants. The sublimed colorants were condensed on the inner surface of a temperature-graduated glass cylinder. Various organic colorants and the purification conditions are detailed in Table 2.

The material to be purified was placed in a container. The pressure in the container was reduced. The material was heated until the material sublimed. Following this general procedure materials of higher vapor pressure at the same temperature condensed and were deposited on the container at cooler zones.

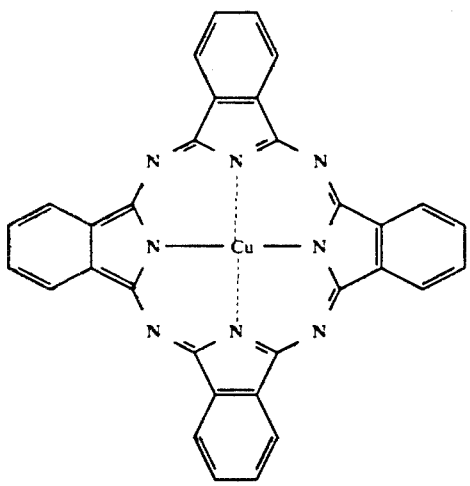

CuPc was purified at $1.3\times10^2$ Pa (1 Torr) under an inert gas atmosphere (argon) at 500° C. using a three zone tube furnace. Alternatively, a simple tube furnace with a linear temperature gradient profile could be used. The CuPc was placed inside a glass (Pyrex) tube. The tube was first mechanically pumped down to 10 mTorr and then the pressure was increased to $1.3\times10^2$ Pa by leaking argon gas into the purification tube. The source material was positioned at the hottest zone in the tube furnace. Pure CuPc, which has the lowest vapor pressure, was deposited at a cooler zone not far away from the source material. The deposits nearer to the source material were larger in crystalline size. The crystalline size of the deposits became smaller with increasing distance from source. The higher vapor pressure impurities were deposited at the cooler zones near the end of the furnace. The separation of pure pigment from impurities was better for materials with large vapor pressure differences between the pure pigment and the impurities.

The pre-purified CuPc was vapor deposited on a 6 μm PET substrate (15.2 cm wide) in a custom-built and diffusion-pumped 30 cm glass bell jar vacuum coater equipped with a 15.2 cm web drive. The pre-purified CuPc source material was placed in a custom-made molybdenum foil heating boat. The source-to-substrate distance ($d_{SS}$) was 4.1 cm. The chamber was pumped down to $6.6\times10^{-4}$ Pa ($5\times10^{-6}$ Torr) and electrical power was applied to raise the temperature of the heater to 419° C., at which temperature the source material vaporized. The 6 μm PET substrate was moving at a rate of 0.46 meters/min. during deposition. The transmission optical density of the coating was 1.4.

EXAMPLE 2

Violet PV19 pigment (available from Ciba Geigy Corp.)

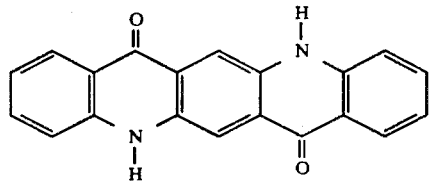

PV19 was pre-purified by vacuum sublimation at $2\times10^2$ Pa (1.5 Torr) at 465° C. under an argon atmosphere. The pre-purified pigment was placed in a heater boat made of 2 mil stainless steel sheet metal. The source-to-substrate distance was 4.1 cm. A 30 cm glass bell jar coater was pumped down to $1.3\times10^{-3}$ Pa ($1\times10^{-5}$ Torr) and electrical power was applied to raise the temperature of the heater to 400° C. The pigment material was vaporized and deposited on a 15.2 cm wide 6 μm PET substrate. The substrate was moving at a rate of 0.47 meters/min. The transmission optical density of the coating was 1.2.

Example 3

Fluorescent Yellow FGPN TM (a mixture of DY11 and 3,5-dimethyl DY11) (available from Keystone Aniline Corp.) was loaded into a cellulose extraction thimble and washed with acetone in a soxhlet extractor. A large portion of the raw material, DY11 was dissolved in the acetone. 3,5-dimethyl DY11 isomer

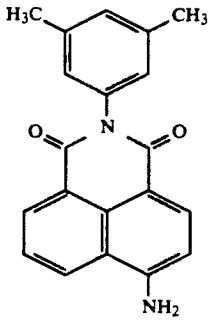

DMDY11 remaining in the thimble, was purified by vacuum sublimation at $3.9\times10^{-4}$ Pa ($3\times10^{-6}$ Torr) at 236° C. The purified material was placed in a heater boat made of 2 mil stainless steel sheet metal. The source-to-substrate distance was 3.8 cm. A 30 cm glass bell jar coater was pumped down to $0.6\times10^{-3}$ Pa ($2\times10^{-5}$ Torr) and electrical power was applied to raise the temperature of the heater to 235° C. The pigment was vaporized and deposited on a 15.2 cm wide 6 μm PET substrate. The substrate was moving at a rate of 0.47 meters/min.

Example 4

Fluorescent Yellow FGPN TM (purified and separated as in Example 3), Pigment Violet 19 TM, and copper phthalocyanine were pre-purified and vapor-deposited on a 6 μm PET substrate. Color patches were transferred to a 5 μm PE200 TM coated thermoplastic PET (available from DuPont de Nemours, E.I., Co.) receptor sheet using an experimental thermal printer (Model II) equipped with a 200 dpi Oki thermal printer head (Printer head Model# DTH 6604E available from Oki Electric Industrial Co. at an energy of ≈2.1 J/cm² (single pulse heating profile). The transmission optical density and transparency were measured using a MacBeth Model TR527 densitometer (MacBeth Instrument Co., Newburgh, NY). Comparison with other donors is compiled and illustrated in Table 2.

TABLE 2

TOD and Transparency of Thermally Transferred Images Commercially 3M Solvent Coated and Vapor Color Pigment Donors

| Transferred | Calcomp* (new) | | GRL-4** | | Vapor Coated Colorant | |
|---|---|---|---|---|---|---|
| Colorant | TOD | Trans.[1] | TOD | Trans. | TOD | Trans. |
| Yellow | 0.64 | 1.02 | 0.99 | 1.69 | 1.40 | 2.68 |
| Magenta | 0.55 | 1.33 | 0.88 | 1.39 | 1.35 | 2.81 |
| Magenta[2] | | | | | 0.59 | 2.77 |
| Cyan | 0.75 | 1.65 | 1.07 | 1.80 | 1.94 | 2.73 |
| Cyan[2] | | | | | 1.74 | 2.75 |

[1]Transparency ∝ $\log_{10}(I_O/I_S)$ wherein $I_O$ is the original light intensity and $I_S$ is the scattered light intensity, the higher the number, the better the transparency.
[2]An adhesive chlorinated wax (Chlorez TM 700, available from Dover Chemical Corp., Dover, OH) layer was vapor pre-coated in the same chamber before the vapor color pigment coating for overprinting purposes.
*Calcomp wax ribbons, commercially available from Calcomp Co., a Sanders Corp. of Anaheim, CA
**Wax ribbons, formulated according to U.S. Pat. No. 4,839,224, Example 9.

EXAMPLE 5

Copper phthalocyanine (available from Sun Chemical Corp.) was vapor-deposited onto a 6 μm PET substrate using the process described in Example 2. Three Samples with a TOD of 0.7, 1.2 and 1.4, respectively, were made. PE 200 TM or PE 222 TM thermoplastic PET (available from DuPont de Nemours, E.I., Co.) or the combination of both were coated on 3 mil PET. The printer energy was gradually increased from ≈1.0 J/cm² to ≈2.5 J/cm². The optical density of the transferred patch was measured for each energy input to demonstrate the dot-growth capability of the color pigment film. In general, the TOD gradually increased from 0 to the respective TOD of the donor used. For example, the OD changes gradually from 0 to 1.4 while the printer energy was varied from 1.3 J/cm² to 2.5 J/cm² when a PE 222 TM coated PET receptor was used.

The low density patches were examined under a microscope. The dot growth that accounted for the density increase was apparent, starting with the clear S shape of discrete heating elements to a fully merged solid area. Since the width of the heating element is ~25 μm, the experiment indicated that the film had resolution capability exceeding 1000 dots per inch ("dpi").

Comparative Example C1

Pre-purified fluorescent Yellow FGPN TM Colorant (separated and purified as in Example 3), Pigment Violet 19 TM colorant, and copper phthalocyanine were vapor-deposited onto 6 μm PET using a process similar to that described in Examples 1 to 3, and solvent overcoated with an adhesive layer comprising, (1) Carboset TM 514H/PVP K15 (Goodyear Tire & Rubber Co.), 1:1, (2) Catapal/Triton TM 100, 2.5:1 (Vista Chemical/Rohm and Haas Co.) 3 to 2 ratio at 5 wt. % and coated with a #7 Meyer rod (R&D Specialties, Inc.). Standard composition of color patches were made through successively transferring onto plain PET using a thermal printer head, printing at an energy of ≈1.6 J/cm².

Example 6

A CR/A coating mixture was prepared by admixing modified acrylics (E327 TM, DeSoto) with Staybelite TM ester (Hercules Inc.) in the weight ratio of 8 to 3. A 2 wt % CR/A solution in toluene was solvent coated on a 6 μm PET film using a No. 3 Meyer rod (dry thickness ~0.1 μm). A CuPc pigment was vapor deposited on top of the CR/A layer (TOD ~0.6, thickness of ~0.1 μm) to form a first pigment film donor sheet. Pigment Violet 19 was direct vapor deposited in a process described in Example 2 on a 6 μm PET substrate to form a second film donor sheet. A 20 wt % solution of the same CR/A coating mixture was solution coated on a 4 mil polyvinylidene chloride (PVDC) primed PET (3M Co.) using a No. 20 Meyer rod (dry weight thickness ~7 μm) to form a matching receptor sheet film.

The Model II printer was used to generate images. Alphanumerics and solid areas were first generated on the receptor sheet using the CuPc donor sheet at a printer energy of ~1.6 J/cm². Pigment Violet 19 alphanumeric and solid areas were then successively overprinted on top of the CuPc images. Clean Pigment Violet 19 dots and solid areas with sharp edges were generated on the previously unimaged areas, imaged areas and over the boundaries. No detectable defects, or size variations were observed.

Example 7

Pigment Yellow PY17 (Diarylide AAOA Yellow TM, available from Sun Chemicals, Corp.)

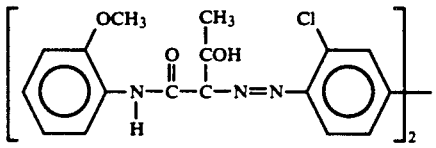

PY17 was used without purification. The material was loaded into a heating boat made of 2 mil stainless steel metal. The source-to-substrate distance was 3.8 cm. The 30 cm glass jar coater was pumped down to $2.6\times10^{-3}$ Pa ($2\times10^{-5}$ Torr) and electrical power was applied to elevate the temperature of the heater. The source material was vaporized and deposited on a 15.2 cm wide 6 μm PET substrate that was moving at a rate of 0.47 meters/min.

Example 8

A CuPc coating was prepared in a vacuum coater equipped with a cryopump. The prepurified CuPc was placed in a heating boat made of 6 mil stainless steel sheet metal. The source-to-substrate distance was 3.8 cm. The chamber was pumped down to $2.6\times10^{-4}$ Pa ($2\times10^{-6}$ Torr). Electrical power was applied to the heating boat to raise the temperature of the inner and outer heater independently. The source material was vaporized and deposited on a 28 cm wide 6 μm thick PET substrate, which was moving at a speed of 6.1 m/min during coating. The transmission optical density of the coating was 2.

Example 9

A CuPc coating was prepared with procedures similar to those described in Example 5 with the following differences: (a) the 6 μm PET substrate was 22.9 cm wide, (b) the PET substrate was pre-coated with a thin layer of anti-slipping agent on its backside; (c) the web speed was 5.1 m/min during coating, and (d) the optical density was 1.8.

Example 10

A CuPc coating was prepared following the procedures as described in Example 1. A thin layer of PE 200 of 2 micrometer thickness was then vapor deposited on top of the CuPc coating.

Example 11

A thin layer of PE 200 TM of 1000 A thick was vapor deposited on a 14.2 cm wide 6 μm thick PET substrate which was moving at a speed of 0.14 m/min during coating. A CuPc coating was then vapor deposited onto the PE 200 TM coating with procedures similar to those described in Example 2.

Example 12

A black donor sheet was produced by sequentially vapor-depositing a thin layer of CuPc, Pigment Violet PV19 and Pigment Yellow PY17 onto a 6 μm thick PET substrate. The substrate was moving at a speed of 15 cm/min. during the deposition. CuPc and Pigment Violet PV19 were purified as described in Examples 1 and 2. Pigment Yellow PY17 was vapor-deposited without prior purification. A receptor sheet consisting of a 7 μm thick CR/A layer (VPE TM 5833: Staybelite TM ester in a ratio of 70:30) on a 2 mil PET substrate.

A model II printer as described in Example 4 was used to generate images. Alphanumerics and solids areas were generated on the receptor sheet using this donor sheet.

Example 13

A black donor sheet was produced by simultaneously vapor-depositing a thin layer of CuPc, Pigment Violet PV19 and (3,5-dimethyl) DY11 isomer onto a 6 μm thick PET substrate. The substrate was moving at a speed of 0.45 meter/min. during the deposition. All the colorants were purified as summarized in Table 1. Pigment Yellow PY17 was vapor-deposited without prior purification. A receptor sheet consisting of a 7 μm thick CR/A layer (VPE TM 5833: Staybelite TM ester in a ratio of 70:30) on a 2 mil PET substrate.

A model II printer as described in Example 4 was used to generate images. Alphanumerics and solids areas were generated on the receptor sheet using this donor sheet.

Example 14

Sudan Yellow dye was vapor-deposited onto a stationary 6 μm thick PET substrate. The colorant layer was 2500 A thick, deposited at a rate of 2000 A/min. and at a pressure of $6.6\times10^{-2}$ Pa ($5\times10^{-4}$ Torr). A receptor sheet consisting of a 7 μm thick CR/A layer (VPE TM 5833: Staybelite TM ester in a ratio of 70:30) on a 2 mil PET substrate.

A model II printer as described in Example 4 was used to generate images. Alphanumerics and solids areas were generated on the receptor sheet using this donor sheet.

Example 15

DY11 isomer separated as described in Example, was purified by vacuum sublimation at 230° C. and 10 mTorr and vapor-deposited onto a stationary 6 μm thick PET substrate precoated with a 0.1 μm thick CR/A layer (VPE TM 5833: Staybelite TM ester in a ratio of 70:30). The colorant layer was 2500 A thick, deposited at a rate of 1800 A/min. and at a pressure of $6.6\times10^{-2}$ Pa ($5\times10^{-4}$ Torr). A receptor sheet consisting of a 7 μm thick CR/A layer (VPE TM 5833: Staybelite TM ester in a ratio of 70:30) on a 2 mil PET substrate.

A model II printer as described in Example 4 was used to generate images. Alphanumerics and solids areas were generated on the receptor sheet using this donor sheet.

Various modifications and alterations of this invention will become apparent to those skilled in the art without departing from the scope and spirit of this invention, and it should be understood that this invention is not to be unduly limited to the illustrative embodiments set forth hereinabove.

We claim:

1. An imaging film comprising a donor sheet, wherein said donor sheet comprises in successive layers:

(a) a substrate;

(b) a controlled release/adhesive layer; and (c) a colorant layer comprising a single layer of vapor-deposited colorant having a microstructure.

2. The imaging film according to claim 1, further comprising an thermoplastic adhesive coating on the surface of said colorant layer.

3. The imaging film according to claim 1, wherein said controlled release/adhesive layer comprises an admixture of two or more thermoplastic polymers or thermoplastic resins, such that said controlled release/adhesive layer is nontacky at room temperature.

4. The imaging film according to claim 3, wherein said admixture comprises at least one compatible polymer and at least one incompatible polymer, wherein said compatible polymer or resin has a greater adhesive affinity to said substrate than does said incompatible polymer or resin and further said incompatible polymer has a greater adhesive affinity to said colorant layer than said compatible polymer or resin.

5. The imaging film according to claim 1, wherein said substrate is a synthetic resin.

6. The imaging film according to claim 5, wherein said synthetic resin is selected from the group consisting of polyesters, polycarbonates, polyvinyl chloride, polyamides, polyimides, polyacrylates, polysulfones, and polyolefins.

7. The imaging film according to claim 6, wherein said synthetic resin is polyethylene terephthalate.

8. The imaging film according to claim 4, wherein said compatible polymer or resin is water-soluble polymers or organic solvent soluble polymers.

9. The imaging film according to claim 4, wherein said incompatible polymer or resin is selected from the consisting of water-soluble polymers or resins, organic solvent soluble polymers, fatty acid polymers, resins and waxes.

10. The imaging film according to claim 4, wherein said compatible and incompatible polymers are sufficiently soluble in each other, such that the admixture does not phase-separate.

11. The imaging film according to claim 4, wherein said controlled release/adhesive layer has a thickness in the range from 0.1 to 1 micrometer.

12. The imaging film according to claim 1 further comprising a receptor sheet comprising a substrate and a controlled release/adhesive layer.

13. The imaging film according to claim 12, wherein said substrate is a synthetic resin.

14. The imaging film accccrding to claim 13, wherein said synthetic resin is selected from the group consisting of polyesters, polycarbonates, polyvinyl chloride, polyamides, polyimides, polyacrylates, polysulfones, and polyolefins.

15. The imaging film according to claim 12, wherein said controlled release/adhesive layer of said receptor sheet is the same admixture as said donor sheet of claim 3.

16. A method of imaging comprising the steps:

(a) bringing a first donor sheet as described in claim 1, wherein said donor sheet comprises sequentially, a substrate, a controlled release/adhesive layer and a vapor-deposited colorant layer on one side of said substrate, in contact with a receptor sheet film, wherein said receptor sheet film comprises a substrate and the same controlled release/adhesive layer as said donor sheet;

(b) applying heat to said substrate imagewise with a thermal printer head to the side opposite said colorant layer;

(c) separating said first donor sheet from said receptor sheet; and (d) optionally, repeating steps 1 to 3, inclusively with a second donor sheet, a third donor sheet, and a fourth donor sheet, wherein said first, second, third, and fourth donor sheet are coated with different colorant layers and said receptor sheet is the same as in step 1.

17. The method according to claim 16, wherein said different colorant layers are selected from cyan, yellow, magenta, magenta-cyan, yellow-cyan, yellow-magenta, yellow-cyan-magenta and black aluminum oxide.

* * * * *

UNITED STATES PATENT AND TRADEMARK OFFICE
CERTIFICATE OF CORRECTION

PATENT NO. : 5,139,598

DATED : August 18, 1992

INVENTOR(S) : Chou et al.

It is certified that error appears in the above-identified patent and that said Letters Patent is hereby corrected as shown below:

Col. 11, line 4, Replace "Chemia" with --Chemie--

Col. 12, line 51, "$f_2 \geq f_1 + f_3(2d/r)$" should be --$f_2 \geq f_1 + f_3(3d/r)$--

Col. 13, line 29, Replace "dicrete" with --discrete--

Col. 15, line 2, "; and" should be --.--

Col. 17, line 59, "OD" should be --TOD--

Col. 19, line 48; Col. 19, line 64; Col. 20, line 9; and
Col. 20, line 25-26, "consisting" should be --consisted--

Col. 18, line 63, "glass jar" should be --glass bell jar--

Col. 20, line 18, "Example" should be --Example 3--

Col. 20, lines 57, 59 and 61, Delete "or resin"

Signed and Sealed this

Twenty-eighth Day of September, 1993

*Attest:*

Bruce Lehman

BRUCE LEHMAN

*Attesting Officer*

*Commissioner of Patents and Trademarks*